US010109917B2

(12) United States Patent
Pace et al.

(10) Patent No.: US 10,109,917 B2
(45) Date of Patent: Oct. 23, 2018

(54) CUPPED ANTENNA

(71) Applicant: Raytheon Company, Waltham, MA (US)

(72) Inventors: Michael T. Pace, Albuquerque, NM (US); Jerret Eastburg, Albuquerque, NM (US); Christopher S. Patscheck, Albuquerque, NM (US)

(73) Assignee: Raytheon Company, Waltham, MA (US)

( * ) Notice: Subject to any disclaimer, the term of this patent is extended or adjusted under 35 U.S.C. 154(b) by 665 days.

(21) Appl. No.: 14/870,277

(22) Filed: Sep. 30, 2015

(65) Prior Publication Data

US 2018/0026368 A1 Jan. 25, 2018

(51) Int. Cl.

| | |
|---|---|
| ***H01Q 13/00*** | (2006.01) |
| ***H01Q 13/02*** | (2006.01) |
| ***H01Q 5/55*** | (2015.01) |
| ***H01Q 5/20*** | (2015.01) |
| ***H01Q 1/28*** | (2006.01) |
| ***H01Q 21/06*** | (2006.01) |
| ***H01Q 21/26*** | (2006.01) |
| *H01Q 15/16* | (2006.01) |

(52) U.S. Cl.

CPC ..... *H01Q 5/20* (2015.01); *H01Q 1/288* (2013.01); *H01Q 5/55* (2015.01); *H01Q 21/062* (2013.01); *H01Q 21/26* (2013.01); *H01Q 15/16* (2013.01)

(58) Field of Classification Search

CPC .... H01Q 13/00; H01Q 13/0233; H01Q 15/16; H01Q 21/0043; H01Q 5/45; H01Q 5/0079; H01Q 13/02; H01Q 5/20; H01Q 5/55; H01Q 21/26

See application file for complete search history.

(56) References Cited

U.S. PATENT DOCUMENTS

| | | | | |
|---|---|---|---|---|
| 3,239,838 A | | 3/1966 | Kelleher | |
| 3,740,754 A | | 6/1973 | Epis | |
| 3,778,838 A | * | 12/1973 | Clavin | H01Q 13/18 343/727 |
| 4,015,264 A | * | 3/1977 | Koerner | H01Q 9/27 343/725 |

(Continued)

OTHER PUBLICATIONS

PCT Search Report and Written Opinion of the ISA dated Jul. 5, 2016; for PCT Pat. App. No. PCT/US2016/026644; 11 pages.

(Continued)

*Primary Examiner* — Tho G Phan

(74) *Attorney, Agent, or Firm* — Daly, Crowley, Mofford & Durkee, LLP

(57) ABSTRACT

Described embodiments provide a cupped antenna for transmitting and receiving radio signals. The cupped antenna includes a cup having a rear surface and one or more side surfaces. The rear surface and side surfaces define a cavity having a first radiating element of the cupped antenna disposed within it. The first radiating element is coupled to a first feed circuit. The one or more side surfaces have one or more indentations disposed therein. The one or more indentations are configured to reduce a size and weight of the cup. The one or more indentations also provide an opening within an aperture of the cupped antenna such that an additional antenna can be disposed within the opening.

28 Claims, 8 Drawing Sheets

(56) References Cited

U.S. PATENT DOCUMENTS

| | | | | |
|---|---|---|---|---|
| 4,109,254 | A * | 8/1978 | Woloszczuk | H01Q 13/18 343/797 |
| 4,218,685 | A * | 8/1980 | Frosch | H01Q 1/28 343/727 |
| 4,668,956 | A | 5/1987 | Mahnad | |
| 5,557,291 | A | 9/1996 | Chu et al. | |
| 5,874,924 | A | 2/1999 | Csongor et al. | |
| 5,892,485 | A * | 4/1999 | Glabe | H01Q 19/108 343/756 |
| 5,929,820 | A | 7/1999 | Caulfield et al. | |
| 6,211,841 | B1 | 4/2001 | Smith et al. | |
| 6,313,809 | B1 * | 11/2001 | Gabriel | H01Q 1/246 343/797 |
| 6,779,397 | B2 * | 8/2004 | Burger | G01F 23/284 340/612 |
| 7,027,004 | B2 * | 4/2006 | Haunberger | H01Q 1/40 343/790 |
| 7,405,710 | B2 | 7/2008 | Bisiules et al. | |
| 8,228,256 | B2 | 7/2012 | Puente Baliarda et al. | |
| 8,593,362 | B2 | 11/2013 | Shea et al. | |
| 2003/0090423 | A1 | 5/2003 | Horii | |
| 2010/0321253 | A1 | 12/2010 | Ayala Vazquez et al. | |
| 2012/0280878 | A1 | 11/2012 | Timofeev | |

OTHER PUBLICATIONS

Ruey-Shi Chu et al.; "Multiband Phased-Array Antenna with Interleaved Tapered-Elements and Waveguide Radiators"; IEEE Antennas and Propagation Society International Symposium, Jul. 1996. AP-S. Digest; pp. 1616-1619.

* cited by examiner

600

610

800

900

CUPPED ANTENNA

BACKGROUND

Cup (or cupped) dipole antennas are known in the art for generating robust and uniform antenna radiation patterns and for providing relatively high aperture efficiencies for relatively small antenna apertures. A conventional cup dipole antenna typically has either crossed dipole antenna elements (for circularly polarized radiation) or a single dipole element (for linearly polarized radiation) disposed in a cavity of a housing (i.e., a so-called "cup") having a circular cross-sectional shape. The cup is formed from a cylindrical conductor coupled at its base with a conducting plate. The dipole antenna elements are recessed within the cup and a coaxial transmission line penetrates the base of the cup to feed the antenna elements. The cup dipole antenna radiation is due to the combination of direct radiation from the antenna elements and reflected radiation from the cup. Using cup dipole antennas in arrays provides for positive operating characteristics such as beam shaping. Cup dipole antennas are commonly employed in satellite communication systems and radar telemetry systems due to their desirable characteristics such as relatively small size, relatively broad bandwidth and uniform radiation patterns. Both satellite communications systems and radar telemetry systems commonly employ the radio bands generally referred to as the "L", "S" and "C" bands. As used herein, each band conforms to the IEEE, definition of the band, for example, the L band refers to radio frequencies between 1.0 and 2.0 GHz, the S band refers to microwave frequencies between 2.0 and 4.0 GHz, and the C band refers to microwave frequencies between 4.0 and 8.0 GHz.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Described embodiments provide a cupped antenna for transmitting and receiving radio signals. The cupped antenna includes a cup having a rear surface and one or more side surfaces. The rear surface and side surfaces define a cavity having a first radiating element of the cupped antenna disposed within it. The first radiating element is coupled to a first feed circuit. The one or more side surfaces have one or more indentations disposed therein. The one or more indentations are configured to reduce a size and weight of the cup. The one or more indentations also provide an opening within an aperture of the cupped antenna such that an additional antenna can be disposed within the opening.

BRIEF DESCRIPTION OF THE DRAWING FIGURES

Other aspects, features, and advantages of the claimed invention will become more fully apparent from the following detailed description, the appended claims, and the accompanying drawings in which like reference numerals identify similar or identical elements. Reference numerals that are introduced in the specification in association with a drawing figure may be repeated in one or more subsequent figures without additional description in the specification in order to provide context for other features. Furthermore, the drawings are not necessarily to scale, emphasis instead being placed on the concepts disclosed herein.

DETAILED DESCRIPTION

Cup dipole antennas are commonly used for transmitting and receiving in the L and S bands. Manned aircraft telemetry is performed in portions of all three of the L, S and C bands. For example, long range air traffic control and surveillance is often performed in the L band, short range (terminal) air traffic control, weather and marine radar is often performed in the S band, and aircraft transponders and long range tracking is commonly performed in the C band. In satellite applications, Global Positioning Satellite ("GPS") communications and maritime emergency communications commonly employ the L band, satellite radio broadcasts (such as Digital Audio Radio Satellite, "DARS") commonly employ the S band, and satellite television broadcasts have historically employed the C band. Recent actions in the United States by the Federal Communications Commission ("FCC") have made portions of the L, S and C bands available for public and commercial use that were previously reserved for other purposes, for example, aircraft telemetry. Further, aircraft telemetry has recently been allocated portions of the C band for use for aeronautical mobile service and aeronautical mobile telemetry. However, many existing aircraft telemetry ground installations currently only support dual-band operation in the L and S bands.

In accordance with concepts described herein, it has been recognized that there is a need for an improved cup dipole antenna, particularly to allow easy retrofitting of existing dual-band installations into upgraded tri-band installations and to allow for increased use in commercial and satellite applications. Thus, described embodiments are directed toward a modified cupped dipole antenna that maintains the desirable electrical characteristics of a conventional cupped dipole antenna (e.g., broad radiation pattern bandwidth, etc.), while reducing size and weight of the antenna structure and providing substantially the same antenna performance. Furthermore, an array of such modified cupped dipole antennas provides a space in which a second antenna can be added such that a greater number of antenna elements can be disposed in a given aperture size. Thus, a second antenna can be provided in the aperture of any antenna provided from one or more of the modified cupped dipole antennas described herein.

Figure 1:
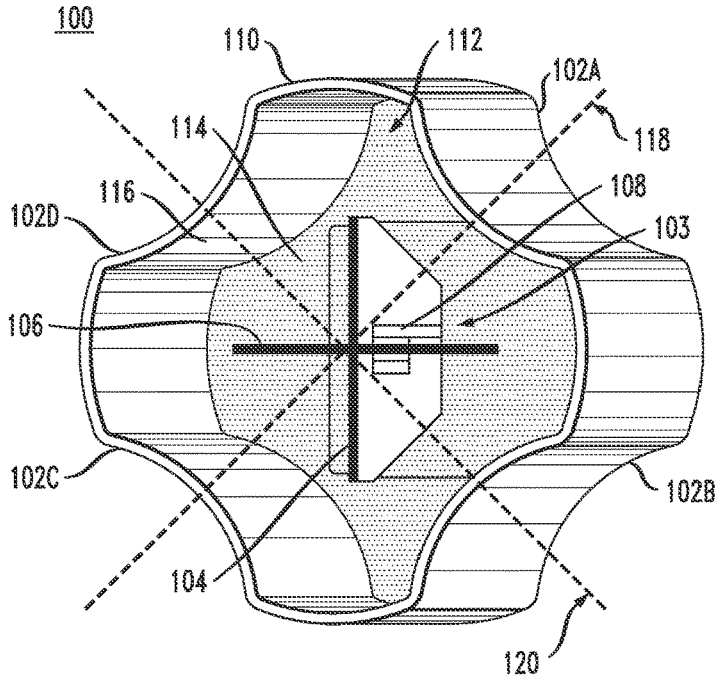
FIG. 1 is an isometric view of an illustrative cupped dipole antenna in accordance with described embodiments.

Referring now to FIG. 1, cupped antenna 100 includes radiating element 103, disposed within a housing or cup 110 and more particularly within cavity 112 of cup 110, where cavity 112 is formed by cup sides 116 and cup rear surface 114. In this illustrative embodiment, radiating element 103 is provided from first and second dipole antennas 104, 106 and hence antenna 100 is referred to as a cupped dipole antenna 100. Those of ordinary skill in the art will appreciate that other types of radiating elements (i.e. other than dipoles) might also be used. For example, several different types of dipoles such as bowties, microstrip, crossed dipoles, etc., could be used. Further, some cupped antennas employ microstrip patches as the center radiator. Any radiator within the cup will have either dual linear orthogonal components, or a single linear component, such that indentations in the cup maintain the general radiation characteristics of a non-indented cup.

Radiating element 103 (e.g., each of dipole antenna elements 104 and 106) is coupled to antenna feed structure 108. As shown in FIG. 1, cup 110 is generally cylindrical in shape with indentations 102A-102D formed or otherwise provided in cup sides 116. In the illustrative embodiment shown, indentations 102A-102D are provided as rounded indentations.

Although shown in FIG. 1, as being cylindrical in shape, cup 110 is not limited only to cylindrical shapes, and could be implemented as any other shape to achieve a cavity in which to dispose radiating element 103. Similarly, although shown as being rounded or arc-shaped, indentations 102A-102D are not limited to rounded or arc shapes, and could be implemented as any other shape (including regular or irregular geometric shapes) to achieve an indentation in cup sides 116. Further, although shown in FIG. 1 as having four indentations, 102A, 102B, 102C and 102D, other numbers of indentations are possible, as will be described. Cupped dipole antenna 100 might operate in one or more frequency bands, for example, one or both of the L and S frequency bands.

As shown in the embodiment illustrated in FIG. 1, indentations 102A-102D might be disposed symmetrically around cup 110. As shown, indentations 102A and 102C are diametrically opposed on the cup as shown by dashed line 118 that extends through a center of the radius of the arc of indentation 102A, through the center of cup 110, and through the center of the radius of the arc of indentation 102C. Similarly, indentations 102B and 102B are disposed directly across the center of cup 110 from each other, for example, as shown by dashed line 120 that extends through the center of the radius of the arc of indentation 102B, through the center of cup 110, and through the center of the radius of the arc of indentation 102B. As shown, dashed lines 118 and 120 (and thus the pair of indentations 102A and 102C, and the pair of indentations 102B and 102D), are generally orthogonal to each other.

In the illustrative embodiment of FIG. 1, indentations 102 are concave insets disposed at a 45 degree angle from the axis of dipole elements 104 and 106 and thus from the direction of the electric field formed by cupped dipole antenna 100. Such position of indentations 102 is selected to reduce, and ideally minimize the effect of the indentations 102 on the electric fields associated with dipole elements 104 and 106.

In embodiments having an even number of indentations 102, such as shown in FIG. 1, symmetrically disposing the indentations 102 around cup 110 maintains symmetry in the antenna radiation pattern of cupped dipole antenna 100 versus the antenna radiation pattern of a cupped dipole antenna without any indentations. As shown in FIG. 1, indentations 102A-102D might be four radius cutout patterns symmetrically disposed around the perimeter of cup 110. As will be explained, indentations 102A-102D have a diameter generally greater than or equal to a radius of a secondary antenna and/or waveguide (or other feed structure) that might be co-located within the aperture of cupped dipole antenna 100.

In described embodiments, the size of indentations 102 is based on the size of the antenna to be co-located within the cavity formed by indentations 102A-102D. However, if indentations 102A-102D become too large, the bandwidth of the cupped antenna could be reduced, or additional impedance matching elements could be required on antenna feed structure 108. In some cases, the secondary antenna might be loaded with a dielectric material to reduce the size of the secondary antenna, and therefore also reduce the size of indentations 102A-102D.

In one embodiment, the diameter of cup 110 of cupped dipole antenna 100 might be approximately 5 inches for operation in at least one of the L and S frequency bands. In such an embodiment, the radius of indentations 102A-102D might be approximately 22 inches such that a C-band waveguide and antenna can be co-located with at least one of cupped dipole antenna 100.

It should be appreciated that although the illustrative embodiment of FIG. 1 includes indentations that are symmetrically disposed around the perimeter of cup 110, in some applications, it might be desirable or necessary to utilize indentations that are asymmetrically disposed around the perimeter of cup 110. It should also be appreciated that although the illustrative embodiment of FIG. 1 includes indentations which are themselves symmetric (e.g., the size, shape and radius of each indentation 102A-102D is the same), in some applications, it might be desirable or necessary to utilize indentations which do not have the same size, shape and/or radius.

Figure 2:
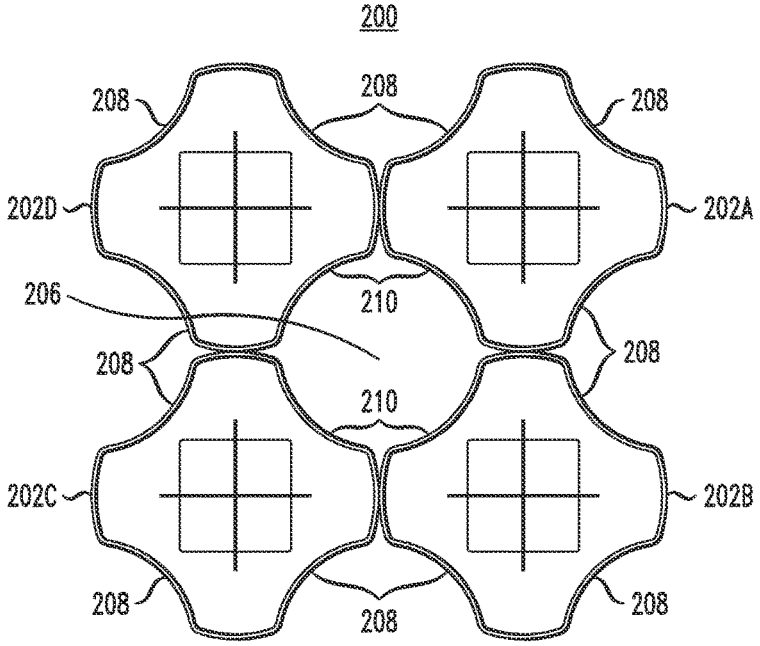
FIG. 2 is a front view of an illustrative four cupped dipole array in accordance with a first described embodiment.

Referring now to FIG. 2, an antenna array 200, is provided from a plurality of cupped dipole antennas, here four cupped dipole antennas 202A-202D such that antenna array 200 is provided as a four-element planar grid array. Each of cupped dipole antennas 202A-202D might be the same as or similar to cupped dipole antenna 100 described in conjunction with FIG. 1. As shown in FIG. 2, inner indentations 210 of each antenna 202 form an opening 206 in array 200 and in particular form an opening in the center of array 200.

As noted above, the radius of center opening 206 (e.g., the radius of inner indentations 210) is sized such that a second, separate antenna (e.g., a C-band waveguide and antenna) can be located within center opening 206. Thus, the aperture of the second, separate antenna (e.g., a C-band antenna not shown in FIG. 2), can be co-located within the aperture of array 200. With such an arrangement, both the second, separate antenna and array 200 can serve as prime focus feeds, without adding additional slot apertures.

The particular type of antenna to dispose within opening 206 might be selected based upon the needs of the particular application. For example, in some applications, it might be desirable to dispose a second cupped array antenna or modified cupped array antenna within the opening 206. In this case, such a second cupped or modified cupped array antenna would operate at a frequency that is significantly higher than the operating frequency of array 200. Thus, the second antenna might comprise a single antenna element or an array of antenna elements.

Furthermore, in some embodiment, the second antenna might be functionally separate from array 200 (i.e. array antenna 200 operates separately from any antenna disposed in opening 206). In other embodiments, however, the second antenna might operate as part of array 200 (i.e. array antenna 200 operates in cooperation with the antenna disposed in opening 206).

As shown in FIG. 2, each of antennas 202A-202D also have optional outer indentations 208. Inclusion of indentations 208 maintains symmetry in array 200. As described in regard to FIG. 1, structural symmetry in an antenna maintains symmetry in the radiation pattern. Thus, inclusion of indentations 208 maintains symmetry in the radiation pattern of array 200.

Although shown in FIG. 2 as a four-element planar grid array including cupped dipole antennas 202A-202D, additional cupped dipole antennas 202 could be added to increase the size of array 200. In such implementations, outer indentations 208 of each antenna 202 would form additional center openings 206, which could be used to co-locate additional antennas and/or waveguides or other feed structures within array 200.

Figure 3:
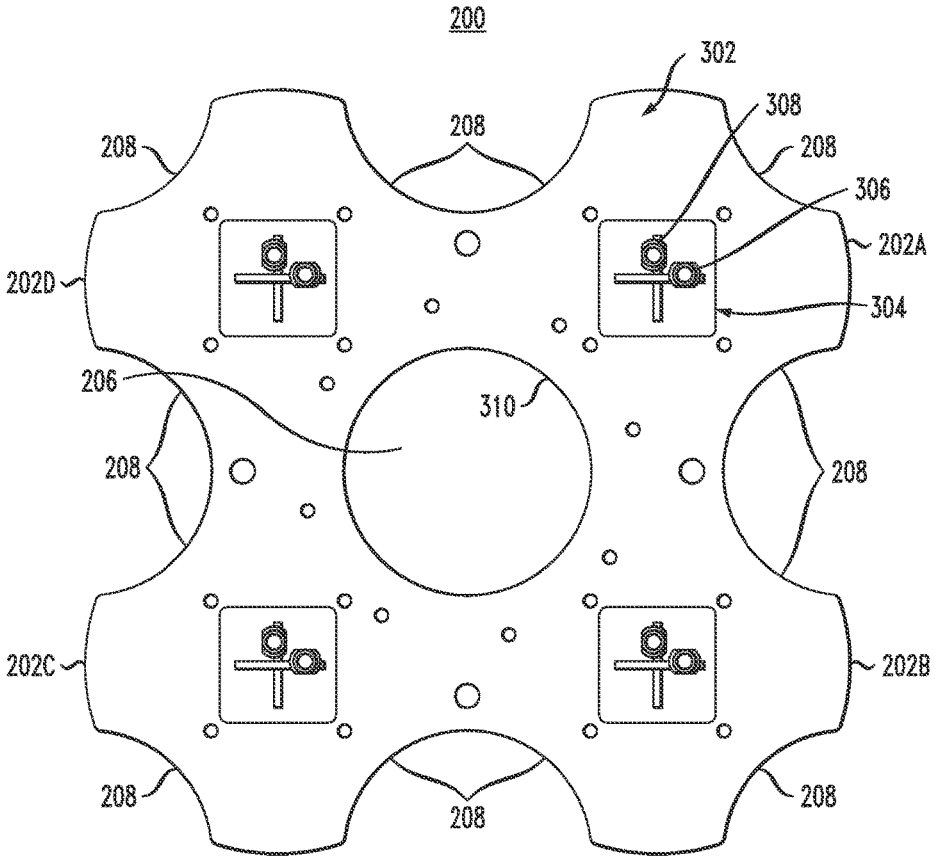
FIG. 3 is a rear view of an illustrative four element cupped dipole array in accordance with a second described embodiment.

As also shown in FIG. 2, in some embodiments, array 200 might be formed by co-locating a plurality of individual cupped dipole antenna structures (e.g., antennas 202A-202D). However, as shown in FIG. 3, array 200 might also be formed by creating multiple cupped dipole antennas from a single structure (e.g., unitary array structure 302). As shown, array structure 302 includes antennas 202A-202D, and a center opening 206 formed or otherwise provided in the center of array 200 and array structure 302, and outer indentations 208 to maintain symmetry in the radiation pattern of array 200 versus the radiation pattern of an array employing cupped dipole antennas without any indentations (or center opening 206).

Whether formed by multiple individual cupped dipole antenna structures (e.g., FIG. 2) or a single array structure (e.g., FIG. 3), each of antennas 202A-202D include feed structure 304 coupled to radiating element 103 (e.g. antenna elements 104 and 106) of each antenna 202 and subsequently to RF circuitry (e.g., a transmitter, receiver, transceiver, etc.). As shown, each antenna element 104 and 106 might typically have a corresponding feed (e.g., feeds 306 and 308 correspond to antenna elements 104 and 106). For simplicity, the RF circuitry coupled to antenna elements 104 and 106 is not shown in the figures, but antennas 202A-202D might typically be coupled to conventional RF circuitry to make frequency, amplitude and phase adjustments to signals after reception by antennas 202A-202D or before transmission by antennas 202A-202D.

Figure 4:
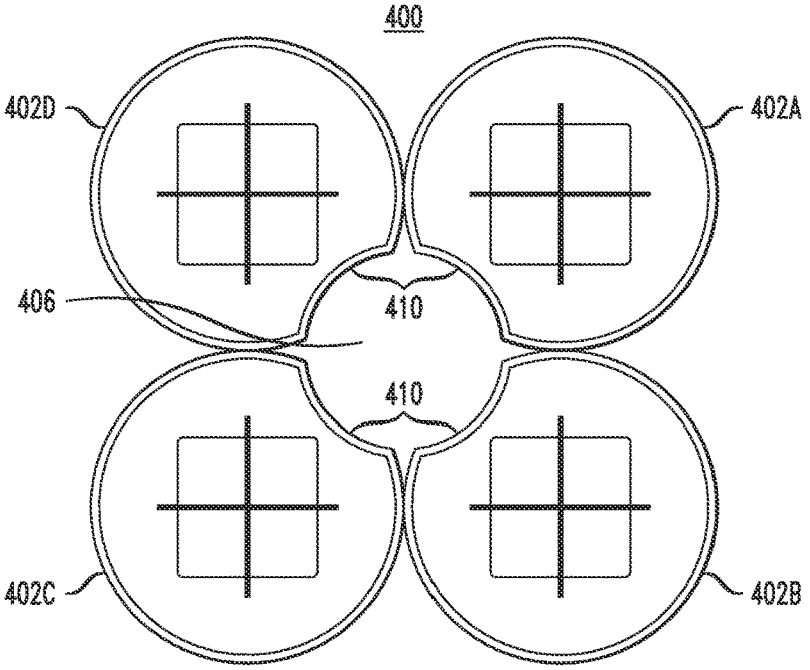
FIG. 4 is a from view of an illustrative four cupped dipole array in accordance with a third described embodiment.

Referring now to FIG. 4, array 400 is provided from a plurality of, here four, antennas 402A-402D such that illustrative array 400 is provided as a four-element planar grid array. Antennas 402A-402D are provided as cupped dipole antennas 402A-402D having indentations 410 that are not symmetrically disposed around cup 110. Rather, antennas 402A-402D only having inner indentations 410 to form a center opening 406 in the center of array 400. As described herein, the radius of center opening 406 (e.g., the radius of inner indentations 410) is sized such that a second, antenna (e.g., a C-band circular wavy guide antenna) can be located within center opening 406. Thus, the aperture of the second antenna (not shown in FIG. 4), can be co-located within the aperture of array 400.

By not employing symmetric outer indentations (e.g., such as indentations 108 and 208 as described in regard to FIGS. 1 and 2), the radiation pattern of array 400 might have a tilted or squinted beam (e.g., an asymmetric radiation pattern), versus the radiation pattern of an array employing cupped dipole antennas without any indentations or an array employing cupped dipole antennas with symmetric indentations. Thus, array 400 might be beneficially employed in systems that are not prime focused (e.g., in off-angle systems).

Figure 5:
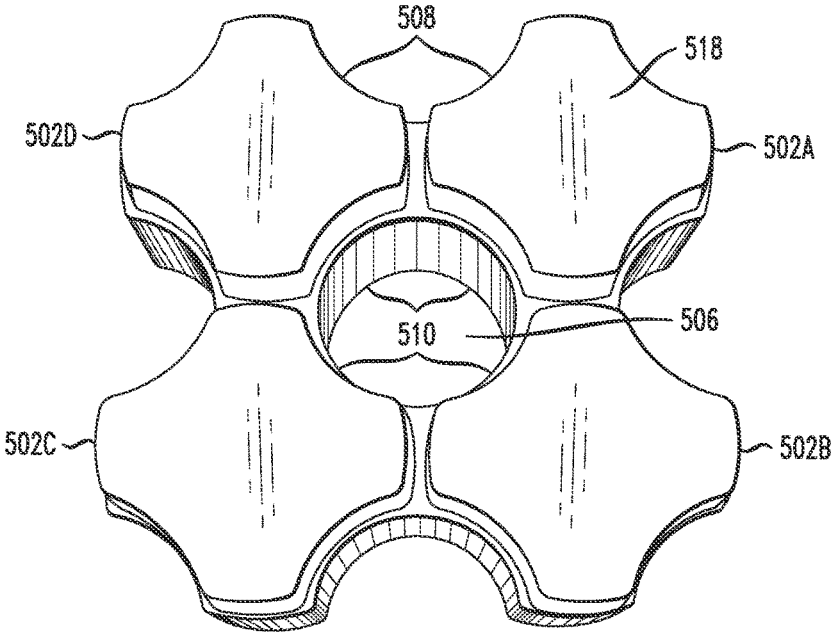
FIG. 5 is a dielectrically loaded four cupped dipole array in accordance with another described embodiment.

Referring now to FIG. 5, a four-element planar grid array 500 includes cupped dipole antennas 502A-502D. As shown, inner indentations 510 form center opening 506 similarly as described in regard to FIGS. 1-4. Array 500 also includes dielectric loading material 518. Dielectric loading of antennas 502 might typically allow the aperture size of antennas 502 to be reduced (e.g., to reduce the overall dimensions or "miniaturize" antenna 502) Thus, dielectrically loaded antennas 502, and correspondingly dielectrically loaded array 500, can be reduced in size as compared with an unloaded antenna (or array) operating in the same frequency range.

In some embodiments, dielectric fill material 518 might be provided as a cross-linked polystyrene copolymer (e.g., polystyrene divinylbenzene) such as Rexolite®. Those of ordinary skill in the art will appreciate that any suitable material used for high frequency substrates, microwave components, and lenses with acoustic, optical and radio frequency applications and having desirable electrical properties at high frequencies might be used. For example, those of ordinary skill in the art will appreciate that any suitable material having similar dielectric and mechanical properties to Rexolite® might be used. Those of ordinary skill in the art will also appreciate how to select a particular dielectric loading material for as in a particular application based upon the needs of the particular application.

In one embodiment, the radius of cupped dipole antenna 502 might be approximately 3.2 inches for operation in the L and S frequency bands. In such an embodiment, the radius of indentations 510 might be approximately 2.2 inches such that a C-band waveguide and antenna can be co-located within center opening 506 of array 500.

Figure 6A:
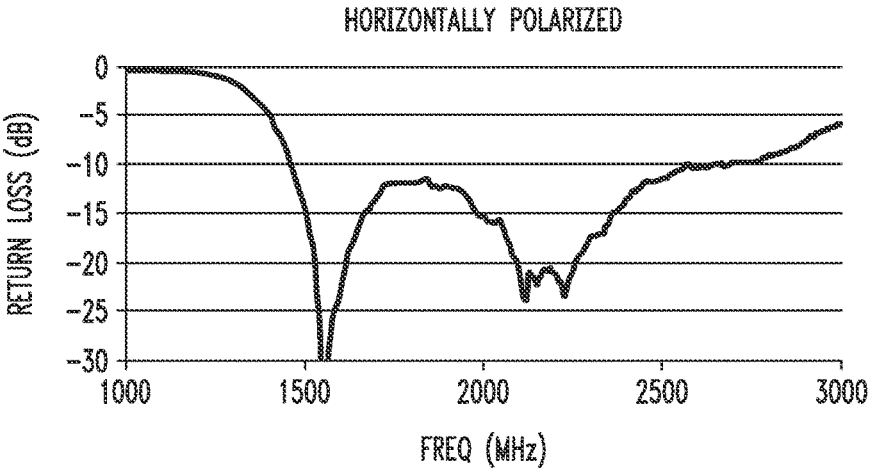
FIGS. 6A and 6B are plots of return loss vs. frequency for the cupped dipole antenna of FIG. 1.
Figure 6B:
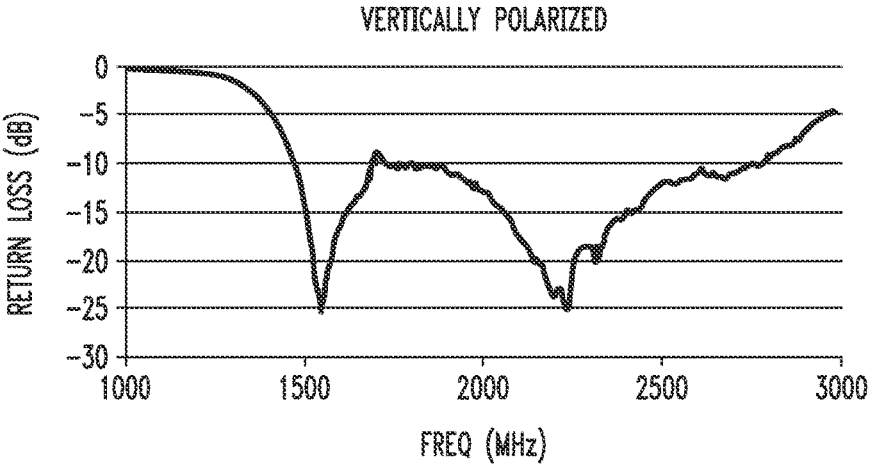

FIGS. 6A and 6B show illustrative impedance bandwidth patterns for cupped dipole antenna 100 described in regard to FIG. 1. As shown in FIGS. 6A and 6B, cupped dipole antenna 100 exhibits desirable return loss characteristics in both the L frequency band (e.g., between 1.45 and 1.85 GHz) and the S frequency band (e.g., between 2.2 and 2.4 GHz), having approximately 55% impedance bandwidth in both a horizontally polarized orientation (FIG. 6A) and a vertically polarized orientation (FIG. 6B). Thus, the symmetrically disposed indentations of antenna 100 maintain the desirable electrical characteristics of a conventional cupped dipole antenna, and also maintain impedance symmetry across the horizontal and vertical polarizations.

Figure 7B:
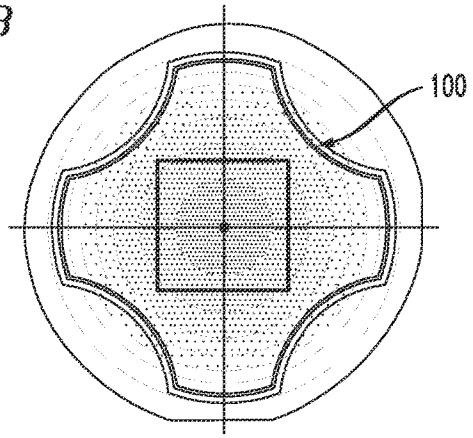
FIGS. 7A-7D are illustrative antenna radiation patterns for the cupped dipole array of FIG. 2.
Figure 7D:
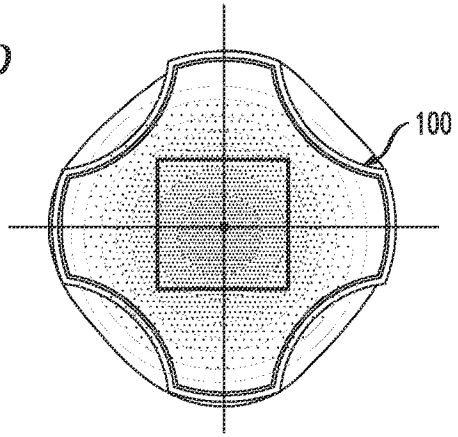
Figure 7A:
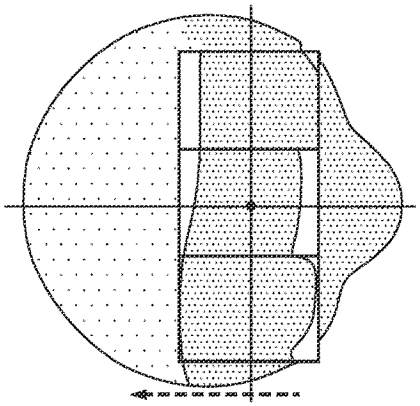
Figure 7C:
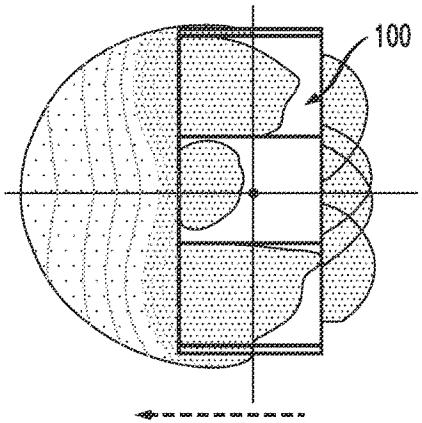

FIGS. 7A-7D show illustrative, radiation patterns for cupped dipole antenna 100 such as described in regard to FIG. 1. FIG. 7A shows the array radiation pattern of antenna 100 at 1435 MHz (e.g., in the L frequency band), where the front of antenna 100 is facing in the direction of the dashed arrow (e.g., the radiation pattern of FIG. 7A shows the radiation pattern in a vertical polarization of antenna 100). FIG. 7B shows a front view of antenna 100 (e.g., the same view as shown of array 200 in FIG. 2), and thus FIG. 7B shows the radiation pattern at 1435 MHz (e.g., in the L frequency band) in a vertical polarization of antenna 100. As shown, in the L frequency band, cupped dipole antenna 100 exhibits approximately 6.2 dBi gain. Thus, as shown in FIGS. 7A and 7B, cupped dipole antenna 100 exhibits desirable antenna radiation patterns in the L frequency band in both a horizontally polarized orientation (FIG. 7B) and a vertically polarized orientation (FIG. 7A). FIG. 7C shows the array radiation pattern of antenna 100 at 2.400 MHz (e.g., in the S frequency band), where the front of antenna 100 is facing in the direction of the dashed arrow (e.g., the radiation pattern of FIG. 7C shows the radiation pattern in a vertical polarization of antenna 100). FIG. 7D shows a front view of antenna 100 (e.g., the same view as shown of array 200 in FIG. 2), and thus FIG. 7D shows the radiation pattern at 2.400 MHz (e.g., in the S frequency band) in a vertical polarization of antenna 100. As shown, in the S frequency band, cupped dipole antenna 100 exhibits approximately 8.5 dBi gain. Thus, as shown in FIGS. 7C and 7D, cupped dipole antenna 100 exhibits desirable antenna radiation patterns the S frequency band in both a horizontally polarized orientation (FIG. 7B) and a vertically polarized orientation (FIG. 7A). Thus, as shown in FIGS. 7A-7D, the symmetrically disposed indentations of antenna 100 maintain the desirable electrical characteristics of a conventional cupped dipole antenna, and also maintain radiation pattern symmetry in both the horizontal and vertical polarizations in both the L and S frequency bands.

Figure 8:
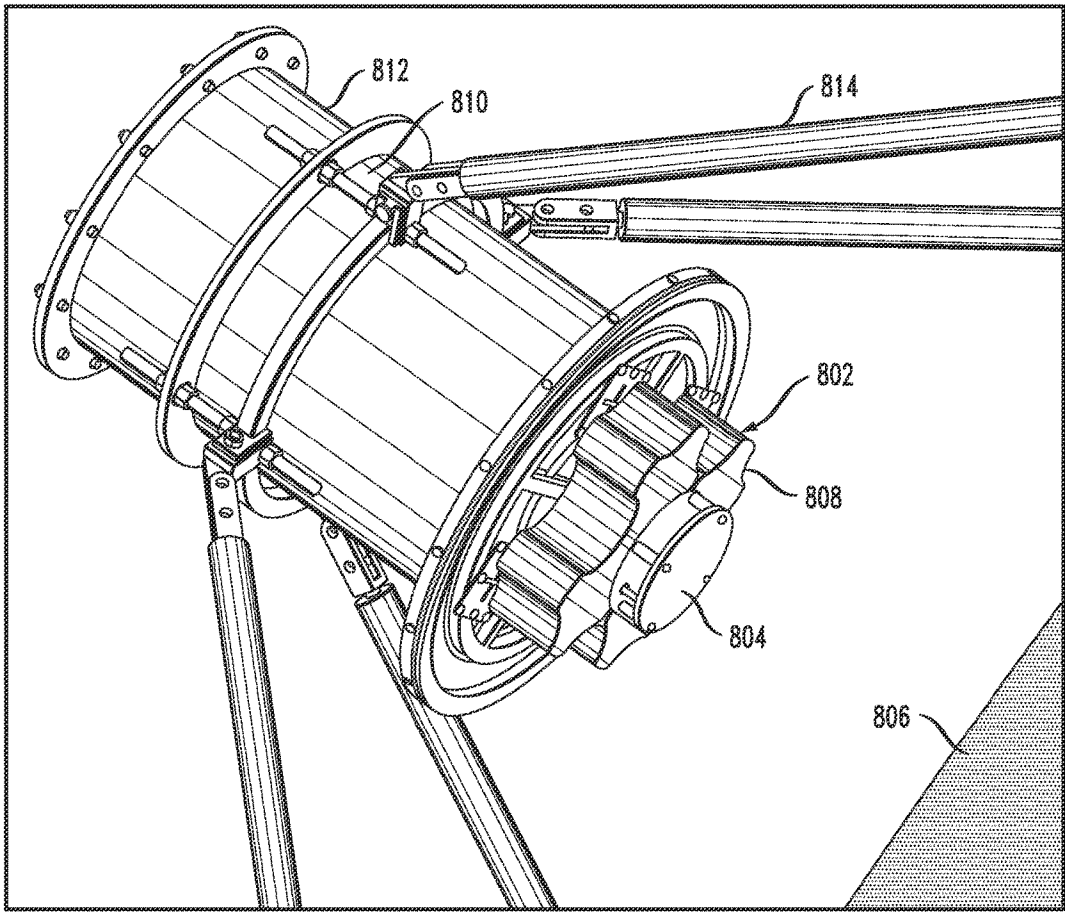
FIG. 8 is an isometric view of a tri-band antenna array and parabolic reflector assembly employing the four element cupped dipole array of FIG. 2.

Referring now to FIG. 8, a reflector system 800 employing the four element cupped dipole array as described in regard to FIGS. 2-5. As shown, parabolic reflector system 800 employs parabolic reflector 806 (e.g., a "satellite dish") to reflect received energy to a focal point of the system. (e.g., the aperture of array 802). It will be appreciated by those of ordinary skill in the art, that only a portion of the reflector 806 is visible in FIG. 8. Array 802 is positioned at a reflector focal point by one or more supports 814 and one or more fasteners 810. Fasteners 810 might be mechanically coupled to housing 812, which is fastened to array 802 and encloses various couplings, cables, and circuitry associated with array 802. Data might be communicated to or from array 802 via one or more cables (not shown) to one or more remote data processing locations (not shown). As described in regard to FIGS. 2-5, array 802 includes a plurality of cupped dipole antennas 808 (four, in the embodiment shown in FIG. 8) and an additional (or second) antenna 804. As described herein, inner indentations in the cups of each of cupped dipole antennas 808 create a center opening in which an additional (i.e. second) antenna and its associated feed are mounted. As shown in FIG. 8, antenna 804 is mounted in the center of array 802 and, thus, the aperture of antenna 804 is within the aperture of array 802. In some embodiments, array 802 is a tri-band array, with cupped dipole antennas 808 operating in the L and S frequency bands, and antenna 804 operating in the C frequency band.

Figure 9:
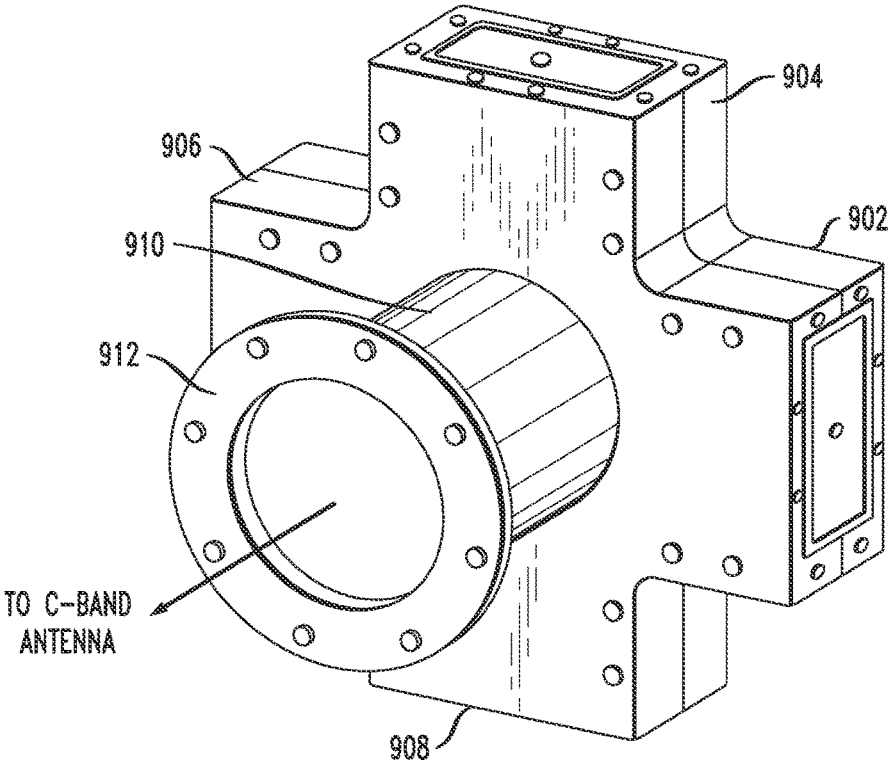
FIG. 9 is an isometric view of a C-band turnstile junction assembly that can be used in conjunction with the tri-band antenna array of FIG. 8.

Referring now to FIG. 9, a C-band turnstile junction assembly 900 is shown. C-band turnstile junction assembly 900 is a single prime-focused feed operable in the C frequency band. C-band turnstile junction assembly 900 allows co-locating multiple antennas to support multiple frequency ranges into a single, compact electronically scanned assembly. In order to maintain sufficient reflector illumination at higher frequencies (for example, the S frequency band), the cupped dipole elements must be closely spaced such that the array factor of the array remains broad enough to increase the efficiency of reflector illumination while also providing enough space to co-locate an additional antenna (e.g., the C-band antenna) and its associated feed, which might be a pseudo-monopulse waveguide such as C-band turnstile junction assembly 900. Thus, C-band turnstile junction assembly 900 must fit within the center opening created by the inner indentations of the cupped dipole antennas (e.g., fit into center opening 206 of array 200) while maintaining sufficiently close spacing for adequate reflector illumination.

As shown in FIG. 9, C-band turnstile junction assembly 900 is a single primary focused compact feed for the secondary antenna (e.g., C-band antenna 804 of FIG. 8). As shown, C-band turnstile junction assembly 90 includes C-band rectangular waveguide feed arms 902, 904, 906 and 908. Waveguide 910 feeds C-band antenna 804 of FIG. 8 located in center opening 206 of the cupped dipole array. Waveguide 910 includes front flange 912 which is mounted to the rear of the cupped dipole array (e.g., the rear surface of array structure 302) and/or antenna 804. In some embodiments, waveguide 910 is a C-band pseudo-monopulse waveguide feed.

Figure 10:
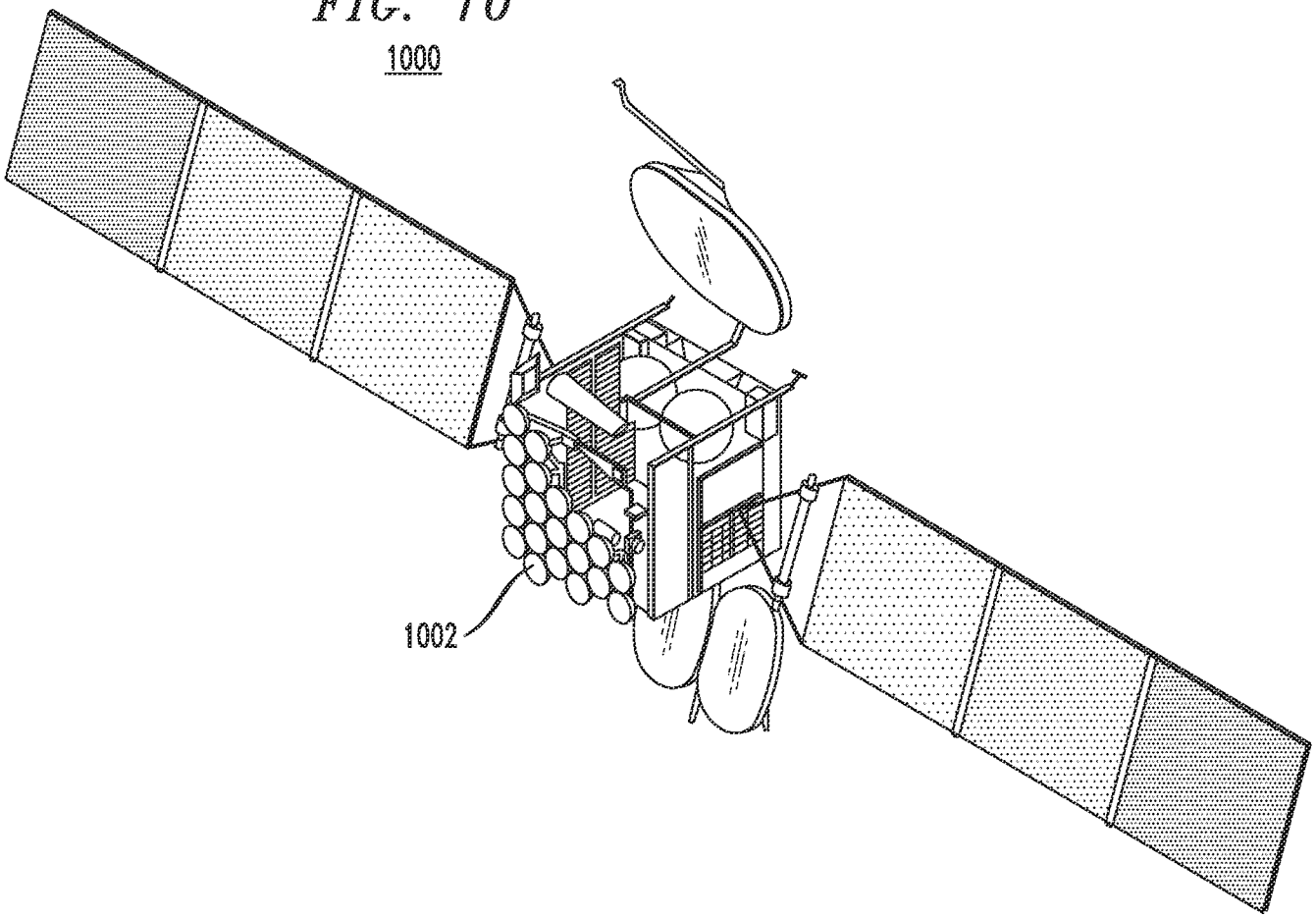
FIG. 10 is an isometric view of an illustrative satellite system employing a plurality of the four element cupped dipole arrays which might be the same as or similar to the cupped dipole array of FIG. 2.

Referring now to FIG. 10, a satellite 1000 employs one or more arrays 1002 of cupped dipole antennas that might be of the types described herein in conjunction with FIGS. 1-5 as described herein. Arrays 1002 might operate in one or more frequency ranges. Even in applications where a tri-band array is not required (e.g., no additional antenna and feed are required to be located within the aperture of the array), cupped dipole arrays as described herein that are formed from cupped dipole antennas having one or more indentations in the cup might desirably be employed. For example, in satellite systems such as shown in FIG. 10, size (i.e. physical space), weight and power (SWAP) are of importance due to the limited physical space available on a typical satellite and the limited weight payload capacity of satellite launch vehicles. It is thus desirable to reduce (and ideally minimize) size, weight and power (SWAP) in space-based systems including space-based communication systems. Therefore, even if tri-band (or dual-band) operation were not necessary, cupped dipole arrays as described herein would reduce the weight of the arrays (e.g., due to decrease mass in the cups modified as describe herein) and also reduce the physical size necessary for the arrays (e.g., through the use of dielectric loading techniques described herein) thereby resulting in improved operation of satellite 1000.

Although described herein in regard to operation in the L, S and C frequency bands, the described embodiments are not so limited, and one skilled in the art would appreciate how to scale the described embodiments to operate in any desired frequency band.

Thus, as described herein, illustrative embodiments provide a cupped antenna for transmitting and receiving radio signals. The cupped antenna includes a cup having a rear surface and one or more side surfaces. The rear surface and side surfaces define a cavity having a first radiating element of the cupped antenna disposed within it. The first radiating element is coupled to a first feed circuit. The one or more side surfaces have one or more indentations disposed therein. The one or more indentations are configured to reduce a size and weight of the cup. The one or more indentations also provide an opening within an aperture of the cupped antenna such that an additional antenna can be disposed within the opening.

Reference herein to "one embodiment" or "an embodiment" means that a particular feature, structure, or characteristic described in connection with the embodiment can be included in at least one embodiment of the claimed subject matter. The appearances of the phrase "in one embodiment" in various places in the specification are not necessarily all referring, to the same embodiment, nor are separate or alternative embodiments necessarily mutually exclusive of other embodiments. The same applies to the term "implementation."

As used in this application, the words "exemplary" and "illustrative" are used herein to mean serving as an example, instance, or illustration. Any aspect or design described herein as "exemplary" or "illustrative" is not necessarily to be construed as preferred or advantageous over other aspects or designs. Rather, use of the words "exemplary" and "illustrative" is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

To the extent directional terms are used in the specification and claims (e.g., upper, lower, parallel, perpendicular, etc.), these terms are merely intended to assist in describing the embodiments and are not intended to limit the claims in any way. Such terms, do not require exactness (e.g., exact perpendicularity or exact parallelism, etc.), hut instead it is intended that normal tolerances and ranges apply. Similarly, unless explicitly stated otherwise, each numerical value and range should be interpreted as being approximate as if the word "about", "substantially" or "approximately" preceded the value of the value or range.

Also for purposes of this description, the terms "couple," "coupling," "coupled," "connect," "connecting," or "connected" refer to any manner known in the art or later developed in which energy is allowed to be transferred between two or more elements, and the interposition of one or more additional elements is contemplated, although not required. Conversely, the terms "directly coupled," "directly connected," etc., imply the absence of such additional elements. Signals and corresponding nodes or ports may be referred to by the same name and are interchangeable for purposes here.

As used herein in reference to an element and a standard, the term "compatible" means that the element communicates with other elements in a manner wholly or partially specified by the standard, and would be recognized by other elements as sufficiently capable of communicating with the other elements in the manner specified by the standard. The compatible element does not need to operate internally in a manner specified by the standard.

It will be further understood that various changes in the details, materials, and arrangements of the parts that have been described and illustrated herein might be made by those skilled in the art without departing from the scope of the following claims.

We claim:

1. A multi-element antenna comprising:

a plurality of cupped antennas coupled by a feed network, each cupped antenna comprising:

a cup having a rear surface and one or more side surfaces wherein the rear surface and one or more side surfaces define a cavity and wherein the one or more side surfaces are provided having one or more indentations disposed therein and wherein the one or more indentations are configured to reduce a size and weight of the cup; and a first radiating element disposed within the cavity, wherein the first radiating element is configured to couple to a first feed circuit.

2. The multi-element antenna of claim 1, further comprising a second radiating element disposed within the cavity orthogonal to the first radiating element, with the second radiating element configured to couple to a second feed circuit.

3. The multi-element antenna of claim 2, wherein each of the first and second radiating elements are configured to operate at one or more frequency bands.

4. The multi-element antenna of claim 3, wherein the cupped antenna is configured to operate at a first frequency band from 1.0 to 2.0 GHz and a second frequency band from 2.0 to 4.0 GHz.

5. The multi-element antenna of claim 1, wherein the one or more indentations comprise:

an even number of indentations substantially symmetrically disposed in the side surfaces of the cup about a center of the cup.

6. The multi-element antenna of claim 5, comprising:

four indentations, a first indentation pair comprising a first indentation and a second indentation disposed opposite the center of the cup from each other, and a second indentation pair comprising a third indentation and a fourth indentation disposed opposite the center of the cup from each other, wherein the first indentation pair and the second indentation pair are disposed substantially orthogonally to each other.

7. The multi-element antenna of claim 6, wherein each of the four indentations are located in an associated quadrant of a front surface of the cup.

8. The multi-element antenna of claim 1, further comprising:

a dielectric loading material disposed within the cavity.

9. The multi-element antenna of claim 8, wherein the dielectric loading material comprises a cross-linked polystyrene divinylbenzene copolymer.

10. The cupped antenna of claim 1, wherein the cup is cylindrical in shape and the one or more indentations comprise rounded arcs.

11. The antenna of claim 1, wherein the plurality of cupped antennas are disposed in a planar grid formation.

12. The antenna of claim 1, wherein the plurality of cupped antennas are disposed in a linear formation.

13. The antenna of claim 1, wherein the antenna is disposed on a satellite.

14. An antenna array comprising:

a plurality of cupped antennas coupled by a feed network to form a cupped antenna array, each cupped antenna comprising:

a cup having a cavity formed by a rear surface of the cup and side surfaces of the cup;

at least one radiating element disposed within the cavity, wherein the at least one radiating element is coupled to a feed; and one or more indentations disposed in the side surfaces of the cup, wherein the one or more indentations are configured to (i) reduce a size and weight of the cup, and (ii) provide an opening within an aperture of the cupped antenna array; and an additional antenna disposed within the opening.

15. The antenna array of claim 14, wherein the additional antenna has an aperture that is within the aperture of the cupped antenna array.

16. The antenna array of claim 14 wherein the antenna array is disposed as a feed for a reflector antenna.

17. The antenna array of claim 16, wherein the reflector antenna comprises a parabolic reflector antenna.

18. The antenna array of claim 16, wherein the cupped antenna array and the additional antenna are both configured as prime focus antennas.

19. The antenna array of claim 14, wherein the cup of each cupped is cylindrical in shape and the one or more indentations comprise rounded arcs.

20. The antenna of claim 19, wherein a radius of each of the rounded arcs of the one or more indentations is selected be greater than or equal to a radius of the additional antenna.

21. The antenna of claim 19, wherein a radius of each of the rounded arcs of the one or more indentations is selected be greater than or equal to a radius of a feed element for the additional antenna.

22. The antenna array of claim 21, wherein the feed element is a cylindrical waveguide feed and the second antenna is configured to operate in at least a frequency band from 4.0 to 8.0 GHz.

23. The antenna array of claim 22, wherein the antenna array is a tri-band array configured to operate in an L frequency band, an S frequency band and a C frequency band.

24. The antenna array of claim 23, wherein the tri-band array is configured to be retrofitted into an existing installation.

25. The antenna array of claim 24, wherein the existing installation comprises one of a satellite communication station and a radar telemetry station.

26. The antenna array of claim 22, wherein the feed element comprises:

a C band waveguide feed, the waveguide feed coupled to the additional antenna; and a plurality of L and S band feeds, each of the plurality of L and S band feeds coupled to a corresponding one of the plurality of cupped antennas;

wherein the waveguide feed is disposed within the opening within the aperture of the cupped antenna array.

27. The antenna array of claim 14, wherein the antenna array is disposed on a monopulse radar system.

28. The antenna array of claim 14, wherein one or more arrays are disposed on a satellite.

* * * * *